United States Patent [19]

Haruvy et al.

[11] Patent Number: 4,872,220

[45] Date of Patent: Oct. 10, 1989

[54] PROTECTIVE COMPOSITE MATERIALS, THEIR PRODUCTION AND ARTICLES OF PROTECTIVE CLOTHING MADE THEREFROM

[75] Inventors: Yair Haruvy, Rehovot; Moshe Katz, Rishon Le-Zion; Abraham A. Horowitz, Rehovot, all of Israel

[73] Assignee: The State of Israel, Atomic Energy Commission, Soreo Nuclear Research Center, Yavne, Israel

[21] Appl. No.: 89,953

[22] Filed: Aug. 26, 1987

[30] Foreign Application Priority Data

Sep. 5, 1986 [IL] Israel ..... 79955

[51] Int. Cl.[4] ..... A41D 3/04

[52] U.S. Cl. ..... 2/243 A; 428/286

[58] Field of Search ..... 428/311.1, 311.5, 316.6, 428/317.9, 283, 286; 2/69, 243 R, 243 A, DIG. 5, DIG. 7

[56] References Cited

U.S. PATENT DOCUMENTS

| | | | |
|---|---|---|---|
| 3,457,918 | 1/1969 | Debelius et al. | 128/142.5 |
| 4,190,696 | 2/1980 | Hart et al. | 2/243 A |
| 4,194,041 | 3/1980 | Gore et al. | 2/DIG. 5 |
| 4,344,999 | 8/1982 | Gohlke | 428/316.6 X |
| 4,454,191 | 6/1984 | von Blucher et al. | 428/244 |
| 4,459,332 | 7/1984 | Giglia | 428/86 |
| 4,554,198 | 11/1985 | von Blucher et al. | 428/143 |

FOREIGN PATENT DOCUMENTS

| | | |
|---|---|---|
| 0037745 | 10/1961 | European Pat. Off. . |
| 223925 | 6/1985 | German Democratic Rep. . |

OTHER PUBLICATIONS

*Chemical Abstracts*, vol. 84, No. 26, 28th Jun. 1976, p. 67, Abstract No. 181586y, Columbus, Ohio, US; and JP-A-76 017 377 (Kuraray Co., Ltd.) 12-02-1976.

*Primary Examiner*—David Werner
*Attorney, Agent, or Firm*—Browdy and Neimark

[57] ABSTRACT

Protective composite material suitable for the making of protective garments to afford protection against noxious and toxic chemicals in the form of vapors, aerosols and particulates. The material comprises a water permeable and essentially pore-free air impermeable polymer ply sandwiched between an air and water permeable cover ply and an adsorbent substance-bearing and air and water permeable inner ply. Various embodiments of such protective material and modes of making it are disclosed.

20 Claims, 1 Drawing Sheet

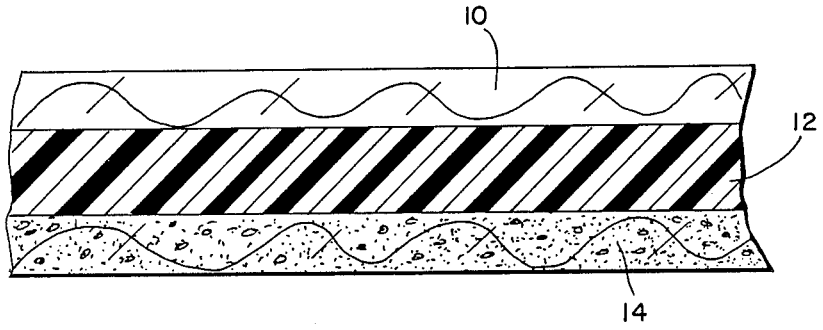
10
12
14

PROTECTIVE COMPOSITE MATERIALS, THEIR PRODUCTION AND ARTICLES OF PROTECTIVE CLOTHING MADE THEREFROM

FIELD OF INVENTION

The present invention relates to material having protective properties, and to various articles such as protective garments, canvases used as covers and partitions and others made therefrom. The protective materials and articles provided in accordance with the invention are adapted to afford protection against weather hazards, such as rain or wind, and/or protection against noxious and toxic chemicals in the form of vapors, aerosols and particulates.

In the following disclosure, the invention will be described occasionally with specific reference to protective clothing, it being understood that it is not confined thereto and that other articles are also contemplated such as, for example, sheets or canvases for making of weather resistant or chemically insulated enclosures in the form of tents or sheds for the protection of humans and animals from weather hazards or a toxic environment; for sealing of openings such as windows and doors to insulate a house from a poisonous environment; for maintaining sterile or clean environments as required in clean rooms and hospitals; and the like.

BACKGROUND OF THE INVENTION AND PRIOR ART

The basic role of protective clothing is to prevent hazardous toxic materials such as chemicals, microorganisms and the like from coming into contact with the living body; to protect from weather hazards; etc.

In principle, such results can be accomplished by making the clothing from a continuous barrier material which is impermeable to water, wind and/or any hazardous or undesirable substances present in the surrounding atmosphere. Impermeable protective clothing, as known to date, however, imposes intolerable restrictions on the natural process of heat dissipation from the human body, which normally occurs by sweat evaporation. The restriction on the thermal regulation of the human body by impermeable protective clothing induces development of thermal stress which may lead in extreme cases to thermal shock and death. Therefore impermeable protective clothing was found unsuitable for prolonged use under any condition, and in particular when the user is expected to perform intensive physical labour.

It is widely accepted in the art that in order to solve the thermal stress problem of protective clothing, adequate means for eliminating the sweat from the interior of the suit to the environment must be found.

Until now, this problem was addressed by using porous protective materials, which allow free flow of air and other gases through their pores and selectively removing or trapping the damaging components present in the surroundings. An example of an embodiment of this approach are the GOR-TEX (trade mark) film sport and rainwear which are made of microporous polytetra fluoro ethylene (PTFE), which allows relatively free passage of gases and water vapor but is not wetted by liquid water, thus providing very efficient water repelency combined with permeability to water vapors and air. Another example of this kind of protective clothing are the so-called "breathing" CBA (chemical, biological, atomic) protective suits, which are based on activated carbon impregnated porous textiles, felts or sponges, which are open to free flow of air. These "breathing" protective clothes allow elimination of the sweat through the pores of the textile while at the same time toxic compounds are adsorbed by the activated charcoal.

While this "breathing" air-permeable protective clothing makes allowance for and reduces the problem of heat dissipation by sweat evaporation, it has the inherent drawback of being permeable also to hazardous vapours, aerosols and particulate materials. Furthermore, the so-called "breathing" clothing are characterized by intrinsic bulkiness due to the fact that they are designed for carrying relatively large loads of adsorbent material required to provide protection against toxic chemicals during a reasonably sufficient period of time. It is also well recognized that the breathing materials also do not provide adequate solution to the physiological load and heat stress problems of the chemical protective garments, and they also may lead to incapacitation and thermal shock and even death under conditions of severe work loads, and high temperatures and humidity. In spite of these inherent short-comings, so far no better solutions have been found and the protective clothing made of "breathing" materials are widely used both for civil and military applications.

German patent specifications DE-A1-31 323 24 and DE-A1-32 009 42 disclose moisture permeable, waterproof airtight textile materials and their use for protective purposes and one of the disclosed embodiments is allegedly applicable for CBA protection. According to the disclosure in these two patent specifications foamed synthetic polymers such as foamed polyurethane, are used with the object of exercising a buffer effect by absorbing sweat as it develops and gradually releasing it to the atmosphere. Several features of the materials disclosed in these patents indicate, however, that they cannot provide simultaneously adequate heat stress relief and chemical protection.

One of the main problems inherent in the protective materials and garments disclosed in DE-A1-31 323 24 and DE-A1-32 009 42 concern their thermal conductivity. It can easily be shown that in order to allow adequate cooling of the body, protective clothing, in addition to being water permeable should also have an as high as possible thermal conductivity and to this end any void due to entrapped gas bubbles should be eliminated as far as possible from the structure of the protective material, having regard to the thermal insulating properties of such voids. The foamed synthetic polyurethane materials used in accordance with the above two German patent specifications have intrinsically a large number of voids and consequently do not allow for adequate body heat dissipation.

Furthermore, due to the accumulation of sweat in the foamed synthetic material in accordance with the teachings of the said two German patent specifications, there results a considerable added weight which contributes significantly to the wearer's discomfort.

The materials described in the above two German patent specifications are not satisfactory, even as far as moisture dissipation is concerned. Thus, the moisture permeability of the protective textiles according to DE-A1-31 323 24 is limited to values of up to 42 $g/m^2/h$ which is considerably lower than the values of 250–500 $g/m^2/h$ eliminated by the human body as sweat during periods of intensive activity.

Moreover, even a capability of eliminating sweat by permeation at a rate of 250–500 g/m²/h or higher, dictated by metabolism, does in itself not necessarily provide the desired cooling effect to the human body. The vaporization heat absorbed during the evaporation process is taken from the immediate vicinity of the evaporation surface. Therefore the efficiency of the cooling effect of the human body depends on the distance of this evaporation surface from the body and on the thermal conductivity of the medium which separates this evaporation surface from the skin. When sweat evaporation occurs in the pores of the human skin itself, the cooling effect achieved is the most efficient possible. However, in the case of a protective garment, particularly if it is airtight even if water permeable, the sweat evaporation may essentially occur only on the external surface of the protective barrier, which is not necessarily in close contact with the skin. As a result, in such cases the cooling efficiency with regard to the human body will be considerably lower than the values expected from considering the amount of sweat eliminated by the body. This effect is aggravated when the protective barrier has a relatively low thermal conductivity in consequence of a porous or foamy structure. Thus, in experiments conducted preparatory to the present invention with known porous, "breathing"protective suits it was shown that even where, in consequence of permeability, the rate of moisture transport was of the order of 250–500 g/m²/h as required by human metabolism, such suits caused inadequately high levels of heat stress in spite of their air permeability. This was true in particular in regard to suits which were based on polyurethane foams and it demonstrates the importance of thermal conductivity for the provision of adequate heat relief.

Summing up, the protective materials and garments disclosed in DE-A1-31 323 24 and DE-A1-32 009 42 have serious intrinsic deficiencies and the disclosure does not provide any evidence that adequate chemical protection and/or heat stress relief was or indeed can be achieved by the disclosed methods and materials.

There are known in the art various non-porous materials with yet a sufficiently high permeability to water to allow efficient thermal regulation of the body by natural sweat and heat elimination processes, examples being polymers such as polyvinyl alcohol, polyvinyl pyrrollidone, acrylamide polymers, polyurethanes, etc. It is also known to impart water permeability properties to common, water impermeable synthetic poly meric materials by grafting techniques. However, while the water permeability of known materials obtained in this way is occasionally sufficiently high to allow water transport rates comparable to the sweating rate of an average person performing intensive physical work, such permeability is as a rule accompanied by a permeability to toxic gases with the consequence that such materials are inadequate for protection against noxious and toxic chemicals in the form of vapors and aerosols.

It is an object of the present invention to overcome the deficiencies of the prior art and provide a non-porous protective material which has yet a sufficiently high water permeability and thermal conductivity to enable adequate heat and moisture dissipation and thereby to afford adequate cooling of the body during intensive labour and at the same time also effective protection against weather hazards and/or noxious and toxic chemicals in the form of vapors, aerosols and particulates.

GENERAL DESCRIPTION OF THE INVENTION

In accordance with the present invention there is provided a protective composite material comprising ply of a continuous water permeable and essentially non-porous and non-foamed synthetic polymeric material sandwiched between an air and water permeable outer cover ply and an adsorbent substance-bearing and air and water permeable inner ply.

The term "adsorbent substance" used herein signifies a substance capable of either or both of physical adsorption and chemical reaction by which noxious materials are detoxified.

The protective composite material according to the invention thus comprises three functional plies, an outer one whose main function is to afford mechanical protection, an intermediary one whose main function is to serve as selective barrier against the penetration of noxious materials, and an inner one whose main function is to adsorb any residual noxious material that penetrates across the intermediary ply. Accordingly, in the following description the new material according to the invention will be referred to at times as "three-ply material", and the water permeable and essentially non-porous and non-foamed synthetic polymeric material ply will at times be referred to as "intermediary ply", it being understood that each of said functional plies may itself consist of several layers.

Preferably, the three-ply material according to the invention is pliable.

The invention further provides protective clothing made of the novel three-ply material specified above.

In the three-ply material according to the invention and the clothing made therefrom, the intermediary, water permeable and porefree ply may be in the form of a prefabricated film or of a coat or lining on the outer face of the inner ply or a coat or lining on the inner face of the cover ply, or both. If desired, the intermediary ply may comprise both a film and at least one coat or lining of the kind specified. It may, furthermore, include optionally an adsorbent substance as herein defined.

The intermediary ply constitutes a physical barrier by which toxic or otherwise hazardous chemicals in the form of vapors, aerosols or particulates are hindered from penetrating across the material. At the same time, due to its water permeability the intermediary ply enables the evaporation of adsorbed sweat and adequate heat transportation to the outside whereby the required thermal regulation is ensured. It is thus seen that the new three-ply material according to the invention combines the good protective property of a continuous porefree barrier material with the heat dissipating capacity of the so-called "breathing" materials.

Any residual chemical material that penetrates across the intermediary ply is adsorbed by the adsorbent material of the inner ply and is thus prevented from reaching the wearer of protective clothing made from, or an enclosure protected by a three-ply material according to the invention.

If desired, either of the outer and inner plies may be rendered water repellent whereby additional protection is afforded.

Preferably the three-ply material according to the invention is rendered resistant against warm water in order to enable its laundering without losing its protective properties. It is further preferred that the protective, three-ply material according to the invention is rendered fire resistant whereby yet another form of protection is afforded. Methods for rendering textile and polymeric materials resistant against fire and hot water are known per se and need, therefore, not be described.

The intermediary, water permeable and essentially air impermeable ply in a three-ply material according to the invention is, as a rule, in the form of a polymeric film such as, for example, a film of polyvinylalcohol (PVA). If desired, the intermediary ply may be made of several layers of different water permeable and essentially air impermeable polymer substances which may be either pure or blends of two or more polymers and which may furthermore be combined with various additives as is conventional in the plastic art. The polymer of the intermediary ply may be non cross-linked or cross-linked, e.g. by the action of a chemical reagent or by irradiation such as with U.V. or ionizing radiation or both.

In addition to making the intermediary ply of two or more superimposed films of different polymeric substances, the intermediary ply may also comprise reinforcing fabrics such as a cotton fabric, a glass fiber fabric and the like.

The inner and cover plies may each comprise a single layer or several layers. Each of them may, for example, be made of woven or non-woven textile fabrics such as of cotton, or of inorganic fabrics, e.g. of glass fiber, asbestos or the like, or of combinations of such textile and inorganic fabrics.

There are known various methods in the art for loading an absorbent material such as, for example, activated charcoal, on woven or unwoven textile material and such known methods may be employed for loading the inner ply of a three-ply material according to the invention with an adsorbent material. Such methods need, therefore, not be described.

The physico-chemical nature of the intermediary ply in a three-ply composite material according to the invention should be such as to provide the required water permeability. This water permeability may be determined, for example, by wetting on one side of the material and exposing the other side to an atmosphere of a relative humidity of 30% and a temperature of 37° C. Under such conditions, the water permeation rate should preferably be 300 $g/m^2/h$ or higher.

An example of a three-ply composite fabric according to the invention produced by conventional lamination techniques is as follows:

Inner ply—a cotton fabric having activated carbon black grains attached thereto by means of a polymer adhesive.

Intermediary ply—a PVA film cross-linked with ammonium-dichromate-$(NH_4)_2Cr_2O_7$.

Outer ply—an aromatic polyamide fabric such as Nomex (trade mark, DuPont).

Prior to lamination, all three plies may be rendered fire proof and resistant against boiling water by methods known per se.

The invention also provides processes for making three-ply composite materials according to the invention, and any such process may be carried out batchwise or continuously.

In accordance with one embodiment of a process for making the three-ply material in accordance with the invention, the three plies are prepared separately and then laid one on top of the other, joined together and laminated. Where it is desired to produce clothing or garments in accordance with the invention, the lamination operation may be followed by cutting, lock-sewing around the edges and sewing to form the desired article of clothing.

The three plies may be joined together by various methods. By one method an adhesive material is used, while by another method use is made of the adhesion properties of the intermediary, water permeable ply. A combination of both methods may also be employed in that either of the inner and outer plies is attached to the intermediary ply by making use of the adhesion properties of the intermediary ply while for attachment of the other ply an adhesive is used.

It is possible, if desired, to produce the intermediary ply forming film in situ by spreading the constituent polymeric material in plasticized form, e.g. in form of an aqueous or organic solvent solution directly on one of the other two plies, followed by evaporation of any solvent and/or curing, whereby a continuous polymer film is formed on the ply serving as substrate. The remaining ply may then be joined by using an adhesive or by making use of adhesion properties of the polymeric intermediary ply. When proceeding in this way, a cross-linking inducing treatment such as irradiation or treatment with a suitable cross-linking agent may, if desired, be incorporated in the manufacturing process.

Where in the production of a composite three-ply material according to the invention use is being made of the inherent adhesion properties of the polymeric material of which the intermediary ply is made, the inner and outer plies between which the intermediary ply is sandwiched are preferably soaked with an appropriate solvent, e.g. water, to soften the intermediary ply. If desired, the solvent may contain any conventional additive and/or cross-linking agent such as, for example, ammonium-dichromate. After wetting, the composite is laminated by the application of pressure and/or heat which results in formation of the three-ply composite material in accordance with the invention.

In performing the method for the production of a three-ply composite material in accordance with the invention serving for making protective clothing, care should be taken to minimize the occurance of air pockets between the plies in order to maximize heat transfer to the outside thereby to insure an efficient heat stress release from the wearer of a garment made of a protective material according to the invention.

BRIEF DESCRIPTION OF THE DRAWING

The sole figure is a diagrammatic cross-section of a three-ply material according to the present invention.

DESCRIPTION OF SPECIFIC EMBODIMENTS

The invention will now be illustrated by the following examples to which it is not limited. In these examples, the production of various three-ply materials according to the invention is described. The sole figure shows such a three-ply material including an air and water permeable outer ply 10, a water permeable non-porous, non-foamed intermediary ply 12, and an air and water permeable and adsorbent substance bearing inner ply 14. From these materials protective garments may be made using ordinary cutting and sewing procedures.

EXAMPLE 1 a. On a 70 $g/m^2$ commercially available cotton fabric, processed for flame retardancy and water and oil repellancy, there was placed a commercial nonwoven batt of fibers loaded with activated charcoal (e.g. MARK of Lantor) to form the absorbing/detoxifying functional layer (I).

b. (I) was covered with 35 μm PVA film (Berton Plastics, USA), to form a two-functional-ply material, (II).

c. (II) was covered with cotton fabric (same as that used in step (a), to form the three-functional-ply material (III), according to the invention.

EXAMPLE 2 a. to b. same as in Example 1. (I–II).

c. (II) was soaked with water and the PVA film was crosslinked by electron beam irradiation (520 kV, 4 mA, 9.6 Mrads) to form a hot-water-stable flexible charcoal supporting fabric with continuous PVA surface (II').

d. (II') was dried for 72 h at room temperature (III').

e. (III') was used together with a cotton fabric in the same manner as in Example 1 step c, to form a three ply material (IV').

EXAMPLE 3 a. to b. same as in Example 1.

c. (II) was soaked with a 2% solution of ammonium-dichromate in deionized water. Excess of the solution was removed by means of absorbing paper (III").

d. (III") was subsequently heat treated in a convection oven, at 70° C., to form a hot-water-stable flexible charcoal supporting fabric with continuous PVA surface (IV").

e. Same as in Example 2.

EXAMPLE 4 a. to e. same as in Example 3, except that in step e. the cotton fabric was replaced with Nomex (trade mark, aromatic polyamide of DuPont) fabric.

EXAMPLE 5 p a. to e. same as in Example 3, except that in step e. the cotton fabric was replaced with Hylla (trade mark, for a cotton-polyurethane-glass three layered fabric of von Bluecher).

EXAMPLE 6 a. to e. same as in Example 1, except that in step b. a film of 30 μm Nylon grafted Acrylamide (NYgAM) water permeable copolymeer [250% graft yield, prepared by raciation induced grafting processes, described in J. Appl. Polym. Sci., 27, 2711 (1982), (Y. Haruvy et al.)], was utilized instead of the PVA film.

EXAMPLE 7 a. to e. same as in Example 1, except that in step b. a commercial film of 30 μm Cellophane (Enka Inc.) was utilized instead of the PVA film.

EXAMPLE 8 a. to e. same as in Example 1.

f. The two outer plies of the material were soaked with water (up to 70% water uptake), and the three ply intermediary product was then laminated by subjecting it for 15 min. at 70° C. to a pressure of $2\times10^4$ N/m$^2$, to form a three-ply end product according to the invention.

EXAMPLE 9 a. Onto a cotton fabric (same as in Example 1 step a.), RTV adhesive (G.E. RTV #118) was applied using a doctor blade, to produce a uniform thin layer (approx. 100 μm thick) covering the cloth. The product was utilized immediately following the preparation.

b. Activated carbon spheric beads, 25–60 mesh (#254434880, BDH), were spread over the adhesive to form a complete cover of carbon spheres on the adhesive, and pressed onto it.

c. The carbon loaded fabric was dried for 24 h at room temperature. Then, the excess amount of the carbon beads was removed from the thus prepared absorbing/detoxifying layer.

d. The product was utilized together with PVA film (PVA facing the carbon spheres side) and a cotton fabric, as described in Example 1 steps b. to c., to produce a three-ply material according to the invention.

EXAMPLE 10 a. to d. same as in Example 9 except that a NYgAM (see Example 6) film was utilized, instead of the PVA film.

EXAMPLE 11 a. to c. same as in Example 9.

d. An intermediary three-ply composite was produced and then laminated in the same manner as described in Example 8 step f., to form the three layered laminate end product.

EXAMPLE 12 a. to d. same as in Example 11, except that Hylla fabric (see Example 5) was utilized for the cover layer instead of the cotton fabric.

EXAMPLE 13 a. to d. same as in Example 11, except that a commercial activated-carbon fabric was utilized instead of the carbon beads (see Example 9).

EXAMPLE 14 a. A commercial adsorbing composite material constituted of cotton fabric, onto which active carbon spheric beads are attached by means of a flexible adhesive (e.g. SARATOGA, of von Bluecher), was used.

b. Same as in Example 9 step d.

c. Same as in Example 11 step d.

EXAMPLE 15 a. Same as in Example 13.

b. The carbon-fabric surface of the carbon-fabric composite was sprayed with deionized water. Excess of water was removed by means of absorbing paper until the water uptake of the carbon composite ply was 17% by weight (add on).

c. The cotton fabric (a 70 g/m$^2$ commercially available cotton fabric, processed for flame retardancy and water and oil repellancy) was sprayed with a 2% solution of ammonium-dichromate in deionized water. Excess of the solution was removed by means of absorbing paper until the solution uptake of the fabric was 46% (add on).

d. On top of the wet carbon ply obtained in step b. (the carbon side upwards) a 35 μm PVA film was spread and the product of step c was placed on top of it to form a three-ply pre-laminate.

e. The pre-laminate of step d was laminated in a preheated press, at a pressure of $2\times10^4$ N/m$^2$ and temperature of 70° C., for 10 min., to form a partially crosslinked laminate.

f. Laminate crosslinking was completed by placing the product of step e. in a thermostated oven, at 75° for 16 h, to form a stable and launderable laminate.

g. The product of step f. was washed in 15% Glycerine solution in deionized water, to form a stable and soft three-ply laminate as end product. In steps b. and c. a solvent other than water may be used.

EXAMPLE 16 a. to g. same as in Example 15, except that Hylla fabric (see Example 5) was utilized for the cover layer, instead of the cotton fabric.

EXAMPLE 17 a. Same as in Example 14.
b. to g. same as in Example 15.

EXAMPLE 18 a. Same as in Example 1.
b. to g. same as in Example 15.

EXAMPLE 19 a. to g. same as in Example 17, except that Nomex (see Example 4) fabric was utilized for the cover layer, instead of the cotton fabric.

EXAMPLE 20 a. A cotton fabric same as in Example 15 step c. was treated in the same manner, except that the concentration of the ammonium-dichromate in the solution was 0.5% instead of 2%.

b. The cotton fabric was laminated with the 35 μm PVA film in the same manner as described in Example 15 steps e. to f., to form a two-ply laminate.

c. to d. same as in Example 15 steps a. to b., except that the waterr uptake was maintained at 35% by weight.

e. The product of step b. was treated in the same manner as described in Example 15 step c. except that pure water was utilized instead of the chromate solution, and the water uptake was maintained at 100% by weight.

f. On top of the product of step c. (carbon side up) was placed the PVA film.

g. The second phase of the lamination was performed in the same manner as described in Example 15, steps e. to g., to form a three-ply stable and soft laminated end product.

EXAMPLE 21 a. to g. same as in Example 20, except that in step c. the material described in Example 14 step a. was utilized, instead of that of Example 13 step a.

EXAMPLE 22 a. to g. same as in Example 20, except that in step c. the material described in Example 1 step a. was utilized, instead of that of Example 13 step a.

EXAMPLE 23 a. to g. same as in Example 21, except that a Nomex (see Example 4) fabric was utilized in step a. instead of the cotton fabric.

EXAMPLE 24 a. to g. same as in Example 21, except that a Hylla (see Example 5) fabric was utilized in step a. instead of the cotton fabric.

EXAMPLE 25 a. to g. same as in Example 22, except that a Hylla (see Example 5) fabric was utilized in step a. instead of the cotton fabric.

It has been found that protective materials exemplified hereinbefore afforded protection for several hours against 1 μl droplets of various noxious materials.

A typical protective clothing based on the above materials will maintain enough heat release (via sweat vapor evaporation and an efficient transfer of the body heat to the cold surface of the clothing) to enable the wearer several hours of functioning without being exposed to the danger of thermal shock. A typical physiological experiment was performed at moderate rate of labour, under climatic conditions of 31° and 60% relative humidity. Under these conditions, the average rectal temperature of the wearers did not exceed 37.8° after 2 hours of the experiment.

We claim:

1. A protective composite material, comprising at least one continuous, water permeable and essentially non-porous and non-foamed synthetic polymeric material sandwiched between an air and water permeable cover ply and an adsorbent substance-bearing and air and water permeable inner ply.

2. A composite material according to claim 1, wherein either of the cover and inner plies is made of a member of the group of woven and non-woven fabric textile fabrics.

3. A composite material according to claim 2, wherein either of the cover and inner plies is made of a combination of a textile fabric and a member of the group of woven and non-woven inorganic fibrous fabrics.

4. A composite material according to claim 1 wherein the intermediary ply is in form of a coat or lining of the outer face of the inner ply.

5. A composite material according to claim 1, wherein the intermediary ply is in form of a coat or lining of the inner face of cover ply.

6. A composite material according to claim 1, wherein the intermediary ply also comprises an adsorbent substance capable of interaction with noxious materials by either of adsorption and chemical reaction.

7. A composite material according to claim 1, wherein the intermediary ply comprises a reinforcing fabric.

8. A protective composite material according to claim 1 wherein each of said plies is prepared separately, and then the so prepared plies are laid one on top of the other and joined together.

9. An article of protective clothing made of a composite material comprising at least one continuous, water permeable and essentially non-porous and non-foamed synthetic polymeric material sandwiched between an air and water permeable cover play and an adsorbent substance-bearing and air and water permeable inner ply.

10. An article of clothing according to claim 9, wherein in said composite material either of the cover and inner plies is made of a member of the group of woven and non-woven fabric textile fabrics.

11. An article of clothing according to claim 10, wherein in said composite material either of the cover and inner plies is made of a combination of a textile fabric and a member of the group of woven and non-woven inorganic fibrous fabrics.

12. An article of clothing according to claim 9, wherein in said composite material the intermediary ply is in form of a coat or lining of the outer face of the inner ply.

13. An article of clothing according to claim 9, wherein in said composite material the intermediary ply is in form of a coat or lining of the inner face of cover ply.

14. An article of clothing according to claim 9, wherein in said conposite material the intermediary ply also comprises an adsorbent substance capable of interaction with noxious materials by either of adsorption and chemical reaction.

15. An article of clothing according to claim 9, wherein in said composite material the intermediary ply comprises a reinforcing fabric.

16. An article of protective clothing according to claim 9 wherein the continuous, water permeable and essentially non-porous and non-foamed synthetic polymeric material is prepared in situ by spreading the constituent polymeric material in plasticized form on at least one of either the water permeable cover ply or the water permeable inner ply to form a two-ply intermediate composite, and the remaining ply is then added and joined.

17. A flexible protective composite material, comprising an air and water permeable outer fabric ply, a substantially continuous and essentially non-porous and non-foamed synthetic polymeric film having a water permeation rate of less than 300 $g/m^2/h$ as an intermediary ply, and an air and water permeable fabric inner ply bearing an adsorbent substance capable of interaction with noxious materials by either of adsorption and chemical reaction.

18. A flexible protective composite material according to claim 17 wherein said intermediary ply is selected from the group consisting of films of cross-linked PVA, nylon grafted acrylamide, and cellophane.

19. A flexible protective composite material according to claim 17 wherein said outer fabric ply is water repellent.

20. A flexible protective composite material according to claim 17 wherein said adsorbent substance comprises carbon particles.

* * * * *